US008042803B2

(12) United States Patent
Lee

(10) Patent No.: US 8,042,803 B2
(45) Date of Patent: Oct. 25, 2011

(54) MEDIA STACKING APPARATUS FOR MEDIA DISPENSER

(75) Inventor: Su-Min Lee, Seoul-si (KR)

(73) Assignee: LG N-SYS Inc., Seoul-si (KR)

( * ) Notice: Subject to any disclaimer, the term of this patent is extended or adjusted under 35 U.S.C. 154(b) by 0 days.

(21) Appl. No.: 12/595,216

(22) PCT Filed: Apr. 8, 2008

(86) PCT No.: PCT/KR2008/001989

§ 371 (c)(1),
(2), (4) Date: Nov. 10, 2009

(87) PCT Pub. No.: WO2008/123742

PCT Pub. Date: Oct. 16, 2008

(65) Prior Publication Data

US 2010/0084802 A1 Apr. 8, 2010

(30) Foreign Application Priority Data

Apr. 9, 2007 (KR) ..... 10-2007-0034652

(51) Int. Cl.
*B65H 29/38* (2006.01)

(52) U.S. Cl. ..... 271/177; 271/306; 271/182; 271/184

(58) Field of Classification Search ..... None
See application file for complete search history.

(56) References Cited

U.S. PATENT DOCUMENTS 4,068,839 A * 1/1978 Bullock et al. ..... 271/180
5,564,544 A 10/1996 Takemoto et al.
6,386,445 B2 5/2002 Imai et al.
6,533,261 B2 3/2003 Katou et al.

* cited by examiner

*Primary Examiner* — Gerald McClain
(74) *Attorney, Agent, or Firm* — Lowe Hauptman Ham & Berner LLP

(57) ABSTRACT

The present invention relates to a medium stacking apparatus for an automatic medium dispenser. A medium stacking apparatus according to the present invention comprises a medium box provided with a seating space allowing medium to be pulled and stacked therein, inlet rollers provided to face each other and to rotate in opposite directions relative to one another so that the medium are pulled into the seating space, a damping unit colliding against the medium pulled into the seating space by the inlet rollers, and a pressing unit for pressing down a trailing end of the medium. The damping unit and the pressing unit are connected to both ends of a link by the pins to cooperate with each other. Thus, the medium are stacked in the seating space, so that the following medium can be pulled therein without any interference. According to the present invention, there is an advantage in that a stacking reliability is enhanced when medium are stacked.

11 Claims, 6 Drawing Sheets

MEDIA STACKING APPARATUS FOR MEDIA DISPENSER

TECHNICAL FIELD

The present invention relates to an automatic medium dispenser, and more particularly, to a medium stacking apparatus for an automatic medium dispenser, which can separate medium one by one and stack medium when a plurality of medium sheets are stacked.

BACKGROUND ART

The term "medium" used herein indicate, for example, bills, checks, tickets, certificates, or the like, and may be various ones that have a thickness much smaller than a width or length thereof.

FIG. 1 is a partial side sectional view of a conventional medium stacking apparatus for an automatic medium dispenser. As shown in the figure, a seating space 2 is provided in a medium box 1. The seating space 2 is a space in which medium M are pulled and then stacked.

Then, the seating space 2 communicates with the outside through an inlet opening 3 through which the medium M are pulled therein. A pair of inlet rollers 4 are provided at the inlet opening 3 for allowing the medium M to be pulled into the seating space one by one. The inlet rollers 4 rotate in opposite directions relative to one another for conveying the medium M and allow the medium M to pass therethrough one by one. The medium M pulled into the seating space by means of the inlet rollers 4 are placed and stacked one by one on a lower portion of the seating space 3.

In the meantime, a supporting plate 6 is provided on a bottom surface of the seating space 2. The supporting plate 6 is installed so that it can move vertically in the seating space 2 to allow the medium M to be continuously stacked. For example, when the medium M are stacked in the seating space 2 to a certain height, the supporting plate 6 moves downward to thereby form a space in which many more the medium M can be stacked.

The medium stacking apparatus as claimed in the prior art has the following problems.

The medium M is conveyed by the inlet rollers 4 and then discharged out of the inlet rollers at high-speed. In addition, a leading end of the medium M which has passed through the inlet rollers 4 collides against a side surface of the seating space 2.

Here, since the medium M has a thickness much smaller than a width or length, the moment the medium M collides against the side surface of the seating space 2, the medium M may be deformed. In other word, the medium M is bent upward or downward and then deformed. If the medium M is bent for both ends thereof to be positioned above the inlet opening 3, a leading end of the following medium M which is pulled in the seating space collides against the deformed medium. Accordingly, there is a problem in that a jamming phenomenon occurs when the medium M are pulled into the seating space or the stacking efficiency is lowered.

DISCLOSURE

Technical Problem

The present invention is conceived to solve the aforementioned problems in the prior art. An object of the present invention is to provide a medium stacking apparatus for an automatic medium dispenser, wherein a jamming phenomenon caused by collision between the medium pulled in a medium box is prevented from occurring to thereby stack the medium steadily.

Technical Solution

According to an aspect of the present invention for achieving the objects, there is provided a medium stacking apparatus for an automatic medium dispenser. The medium stacking apparatus comprises a medium box provided with a seating space allowing medium to be pulled and stacked therein; inlet rollers provided to face each other and to rotate in opposite directions relative to one another so that the medium are pulled into the seating space; and a guiding means absorbing an impact exerted on a leading end of the medium pulled into the medium box by the inlet rollers and pressing down the medium after the medium collides against the guiding means.

The guide means may comprise a damping unit colliding against the leading end of the medium conveyed by the inlet rollers; and a pressing unit rotating in cooperation with the damping unit to press down a trailing end of the medium.

An elastic member may be provided between a rear surface of the damping unit and the medium box to exert a restitution force on the damping unit when the medium collides against the damping unit.

The damping unit may be hinged to one surface of the medium box; and the damping unit may comprises a collision plate formed of a plate having a small thickness and inclined downward to face a bottom surface of the medium box to collide against the leading end of the medium, and a rotating plate having a width relatively smaller than that of the collision plate and rotating together with the collision plate when the leading end of the medium collides against the collision plate.

The pressing unit may be rotated about a rotational shaft having both ends supported to the medium box, wherein the pressing unit may have a pin ring provided at a position spaced apart from the rotational shaft by a predetermined distance, and the pin ring may be connected to the damping unit to cooperate therewith.

The pressing unit and the damping unit may be connected to each other through a link, wherein the link may have link rings provided at both ends thereof, the link rings may allow a pin as a rotational shaft to pass therethrough, and the link may be connected to the rotating plate of the damping unit and the pin ring of the pressing unit through the pins, respectively.

According to another aspect of the present invention, there is provided a medium stacking apparatus for an automatic medium dispenser, which comprises a medium box provided with a seating space allowing medium to be pulled and stacked therein; inlet rollers provided to face each other and to rotate in opposite directions relative to one another so that the medium are pulled into the seating space; a damping unit colliding against a leading end of the medium pulled into the seating space by the inlet rollers and being provided with an elastic member on a rear surface thereof to exert a restitution force when the collision of the medium; and a pressing unit for pressing down a trailing end of the medium after the collision of the leading end of the medium.

The damping unit may be hinged to one surface of the medium box; and the damping unit may comprises a collision plate formed of a plate having a small thickness and inclined downward to face a bottom surface of the medium box to collide against the leading end of the medium, and a rotating plate having a width relatively smaller than that of the collision plate and rotating together with the collision plate when the leading end of the medium collides against the collision plate.

The pressing unit may be rotated about a rotational shaft having both ends supported to the medium box, wherein the pressing unit may have a pin ring provided at a position spaced apart from the rotational shaft by a predetermined distance, and the pin ring may be connected to the damping unit to cooperate therewith.

The pressing unit and the damping unit may be connected to each other through a link, wherein the link may have link rings provided at both ends thereof, the link rings may allow a pin as a rotational shaft to pass therethrough, and the link may be connected to the rotating plate of the damping unit and the pin ring of the pressing unit through the pins, respectively.

According to a further aspect of the present invention, there is provided a medium stacking apparatus for an automatic medium dispenser, which comprised a medium box provided with a seating space allowing medium to be pulled and stacked therein; inlet rollers provided to face each other and to rotate in opposite directions relative to one another so that the medium are pulled into the seating space; a damping unit colliding against a leading end of the medium pulled into the seating space by the inlet rollers; a pressing unit rotating in cooperation with the damping unit and pressing down a trailing end of the medium after the medium collides against the damping unit; and a link provided with link rings at both ends thereof to connect the damping unit and the pressing unit, the link rings being connected to pin rings through pins, respectively, the pin rings being provided on the damping unit and the pressing unit.

An elastic member may be provided between a rear surface of the damping unit and the medium box to exert a restitution force on the damping unit when the medium collides against the damping unit.

The damping unit may be hinged to one surface of the medium box; and the damping unit may comprises a collision plate formed of a plate having a small thickness and inclined downward to face a bottom surface of the medium box to collide against the leading end of the medium, and a rotating plate having a width relatively smaller than that of the collision plate and rotating together with the collision plate when the leading end of the medium collides against the collision plate.

The pressing unit may be rotated about a rotational shaft having both ends supported to the medium box, wherein the pressing unit may have a pin ring provided at a position spaced apart from the rotational shaft by a predetermined distance, and the pin ring may be connected to the damping unit to cooperate therewith.

Advantageous Effects

According to a medium stacking apparatus for an automatic medium dispenser of the present invention, the following advantages can be expected.

In the present invention, when medium is pulled into a seating space by inlet rollers, a leading end of the medium collides against a front end of a collision plate and a trailing end of the medium is then pushed down by a rotating plate. Accordingly, a space for the following medium to be pulled therein is formed, whereby the medium are stably stacked in the seating space without any interference. Thus, there is an advantage in that a reliability of the operation of the medium stacking apparatus can be increased.

BEST MODE

Hereinafter, preferred embodiments of a medium stacking apparatus for an automatic medium dispenser according to the present invention will be described in detail with reference to the accompanying drawings.

Figure 1:
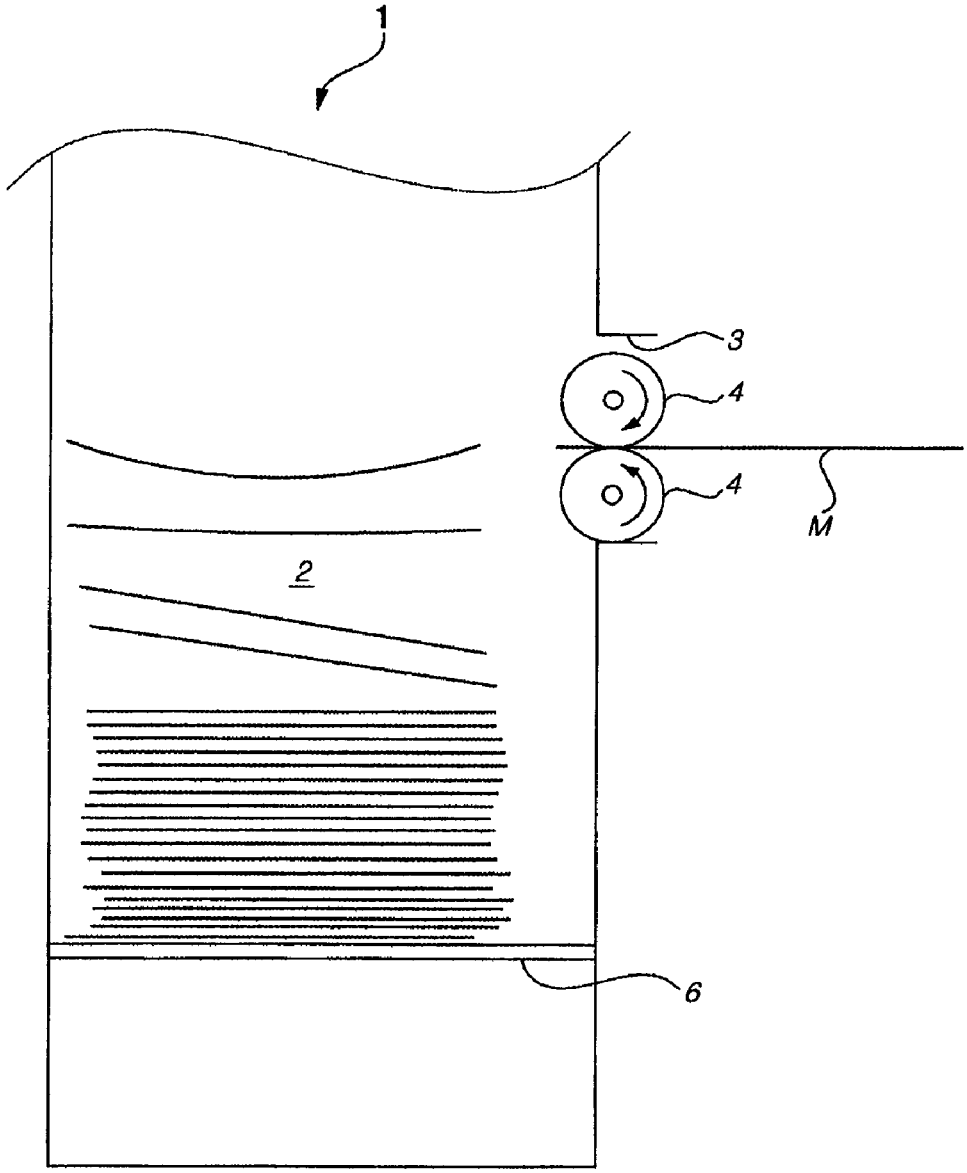
FIG. 1 is a sectional perspective view of a conventional medium stacking apparatus for an automatic medium dispenser.
Figure 2:
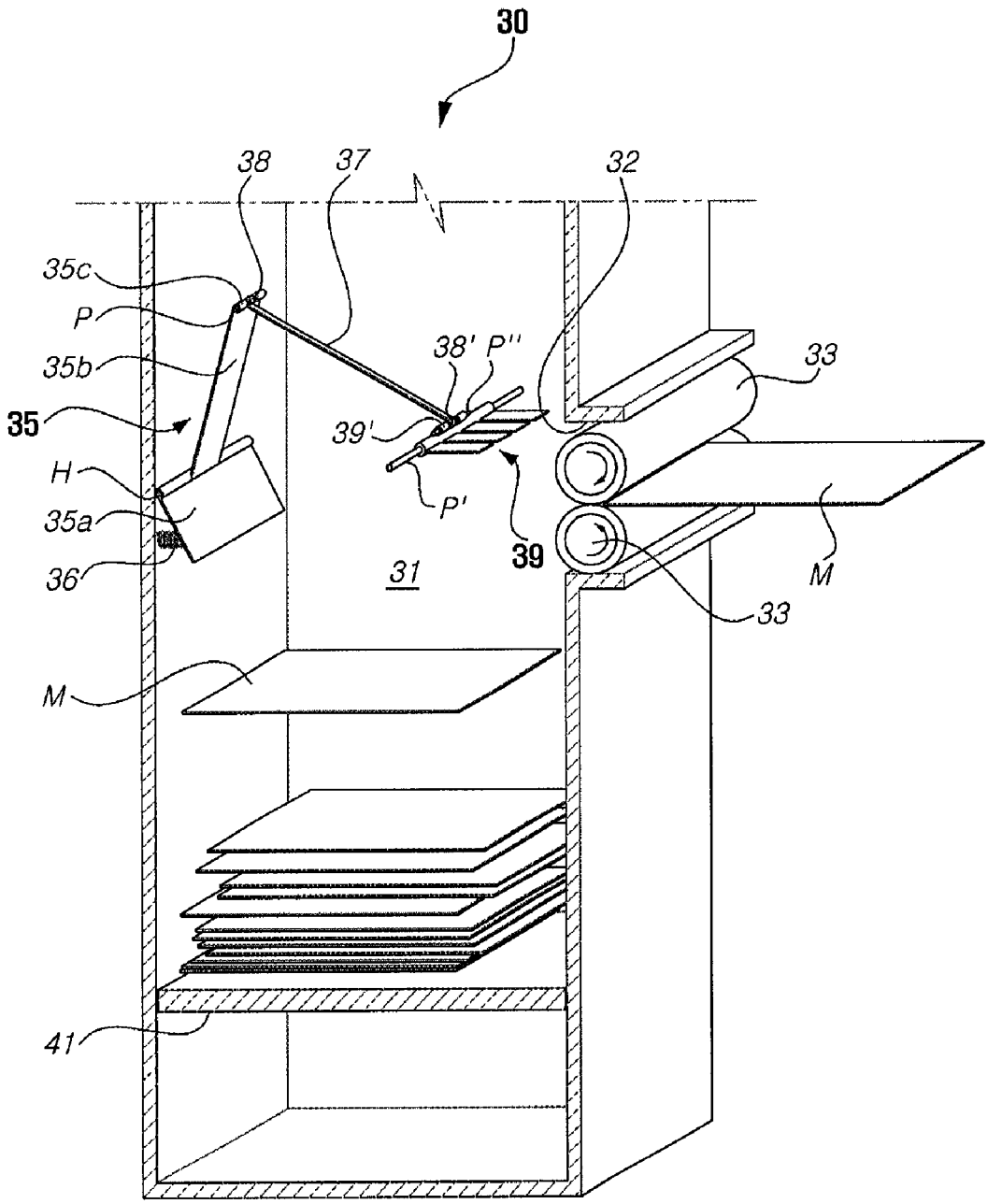
FIG. 2 is a sectional perspective view showing a preferred embodiment of a medium stacking apparatus for an automatic medium dispenser according to the present invention.
Figure 3:
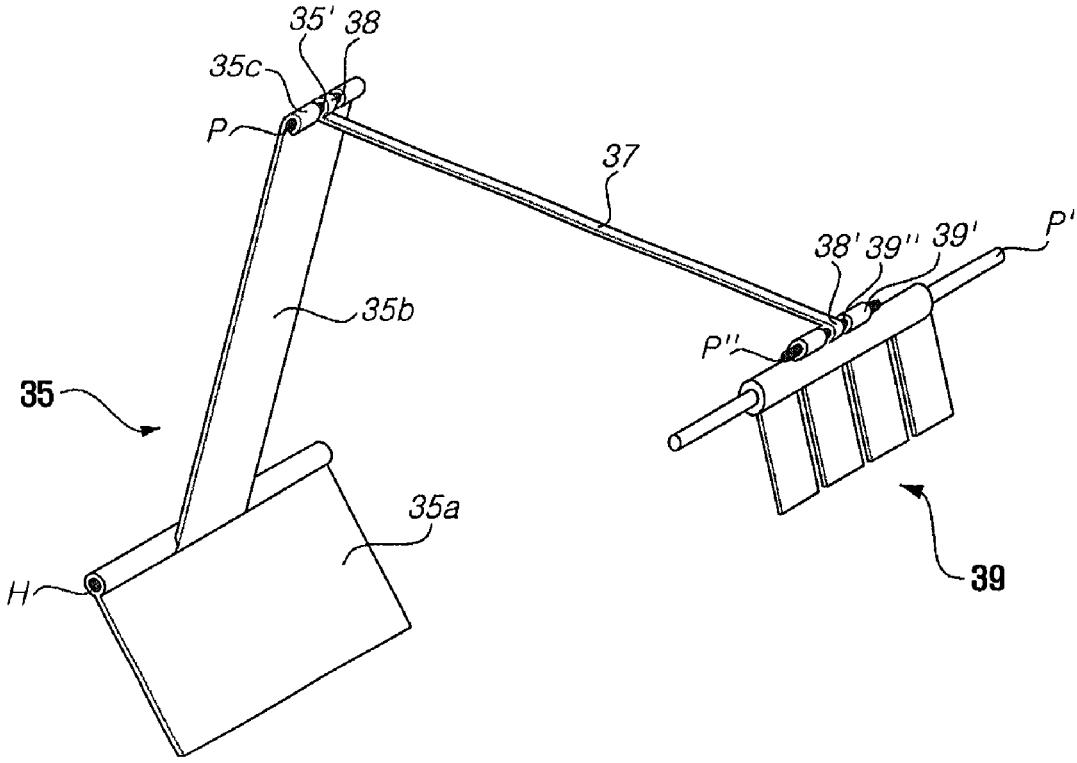
FIG. 3 is a perspective view showing the configuration of a damping unit and a pressing unit of the embodiment of the present invention.

FIG. 2 is a partial sectional perspective view showing a preferred embodiment of a medium stacking apparatus for an automatic medium dispenser according to the present invention, and FIG. 3 is a perspective view showing the configuration of a damping unit and a pressing unit of the embodiment of the present invention.

As shown in the figures, a seating space 31 in which medium M can be stacked is provided in a medium box 30. The seating space 31 communicates with the outside through an inlet opening 32 through which the medium M are pulled in the seating space.

The inlet opening 32 is provided at one side of an upper portion of the seating space 31. In addition, a pair of inlet rollers 33 for allowing the medium M to be pulled into the seating space 31 are provided at the inlet opening 32, wherein the inlet rollers are vertically disposed to face each other. The inlet rollers 33 rotate in opposite directions relative to one another, so that two or more of the medium M cannot pass simultaneously between the inlet rollers but pass one by one between the inlet rollers.

In the meantime, a damping unit 35 is provided in the seating space 35 to face the medium M pulled in the seating space 35. The damping unit 35 includes a collision plate 35*a* having small thickness and inclined downward to face a bottom surface of the medium box 30, and a rotating plate 35*b* having a width relatively smaller than that of the collision plate 35*a* and being inclined upward to face an upper portion of the seating space. Each of the collision plate 35*a* and the rotating plate 35*b* is provided at a certain angle with respect to an inner surface of the medium box 30.

The damping unit 35 is rotatably installed to one sidewall of the medium box 30 through a hinge H, and the collision plate 35*a* and the rotating plate 35*b* can rotate together about the hinge H. At this time, since each of the collision plate 35*a* and the rotating plate 35*b* is inclined at a certain angle with respect to the inner surface of the medium box 30, the rotating plate 36*b* rotates backward if the collision plate 35*a* rotates forward, and the rotating plate 36*b* rotates forward if the collision plate 35*a* rotates backward.

In addition, an elastic member 36 is provided at a rear side of the collision plate 35*a*. The elastic member 36 provided between a rear surface of the collision plate 35*a* and the medium box 30 has one end connected to the collision plate 35*a* and the other end fixed to an inner surface of the medium box 30 to which the damping unit 35 is connected through the hinge H. In addition, the elastic member 36 provides elastic force so that the collision plate 35*a* rotates to its origin location when a leading end of the medium M collides against the collision plate 35*a*.

In addition, an upper end of the rotating plate 35*b* is bent to form a first pin ring 35*c*, and a portion of the first pin ring 35*c* is cut away to form a first pin ring groove 35'. There is provided a pin P passing through the first pin ring 35*c*, and a first link ring 38 of a link 37 to be described later is rotatably caught to the pin P exposed through the first pin ring groove 35'.

In the meantime, the link 37 is provided for connecting the damping unit 35 and a pressing unit 39 to be described later. The first link ring 38 formed by being bent in a cylindrical shape is provided at one end of the link 37, so that the first link ring is rotatably connected to the pin P provided in the first pin ring groove 35'. A second link ring 38' is provided at the other end of the link 37 and then connected to a second pin ring 39' of the pressing unit 39, which will be described below.

The pressing unit 39 provided with the second pin ring 39' to which the second link ring 38' is fixed serves to press down a trailing end of the medium M when the medium M is pulled into the medium box. A pin P' provided to pass through the pressing unit 39 is fixed to both inner side surfaces of the medium box 30, and the pressing unit 39 is rotated about the pin P' as a rotating shaft.

In addition, the second pin ring 39' is provided at an upper portion of the pressing unit 39, wherein the second link ring 38' of the link 37 is connected to the second pin ring through a pin P". The second pin ring 39' is provided at a position spaced apart from the rotational center of the pressing unit 39 by a predetermined distance, and a portion of the second pin ring is removed to form a second pin ring groove 39". The pin P" is provided to pass through the second pin ring 39', and the second link ring 38' of the link 37 is rotatably caught to the pin P" exposed through the second pin ring groove 39".

At this time, the second pin ring 39' is fixed at a position spaced apart from the rotational center of the pressing unit 39 by a predetermined distance, whereby the link 37 cooperates with the pressing unit 39. That is, in cooperation with the link 37, the second pin ring 39' and the pressing unit 39 are rotated clockwise or counterclockwise in the drawing, thereby pressing down a trailing end of the medium M pulled into the medium box.

In the meantime, a supporting plate 41 is provided on a bottom surface of the seating space 31. The supporting plate 41 moves vertically in the seating space 31 to thereby adjust a vertical height of the seating space 31 freely. For example, if the medium M are stacked in the seating space 31 to a certain height, the supporting plate 41 moves downward to adjust a vertical height of the seating space 31 so that many more the medium M can be stacked.

Hereinafter, the operation of the medium stacking apparatus of an automatic medium dispenser according to the present invention so configured will be described.

Figure 4:
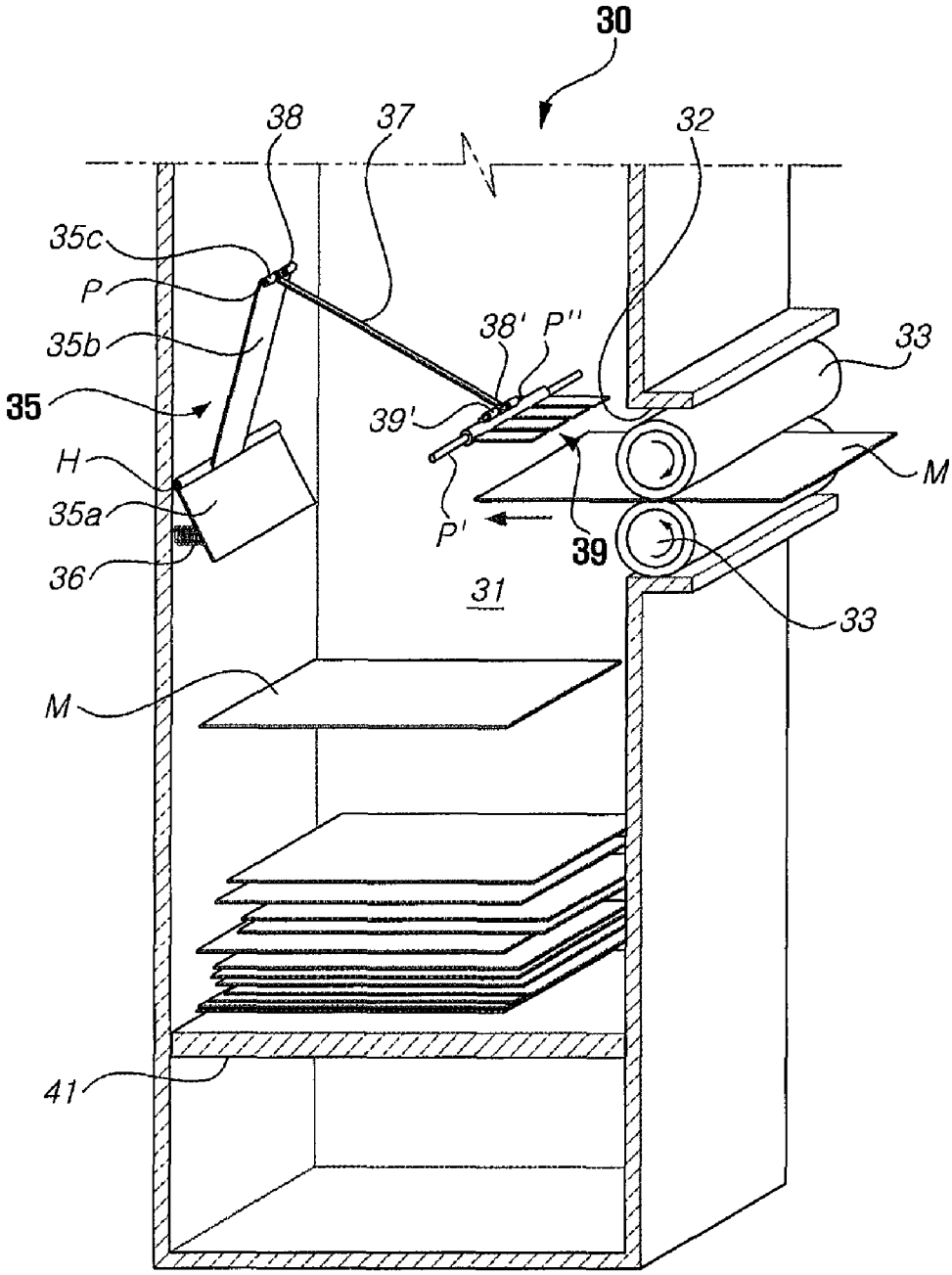
FIGS. 4 to 6 are operation state views showing a process of stacking medium by the medium stacking apparatus of an automatic medium dispenser according to the present invention.
Figure 5:
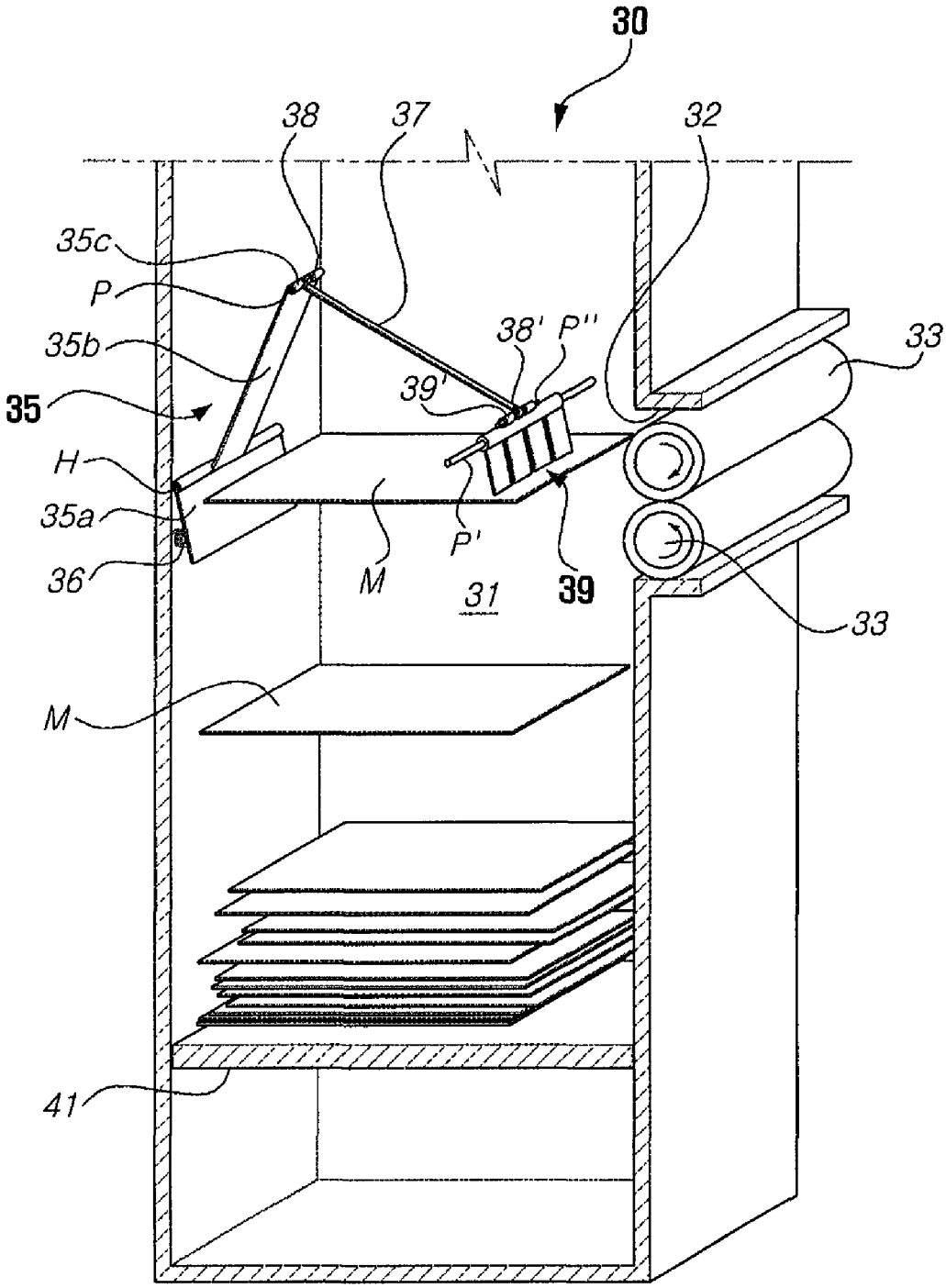
Figure 6:
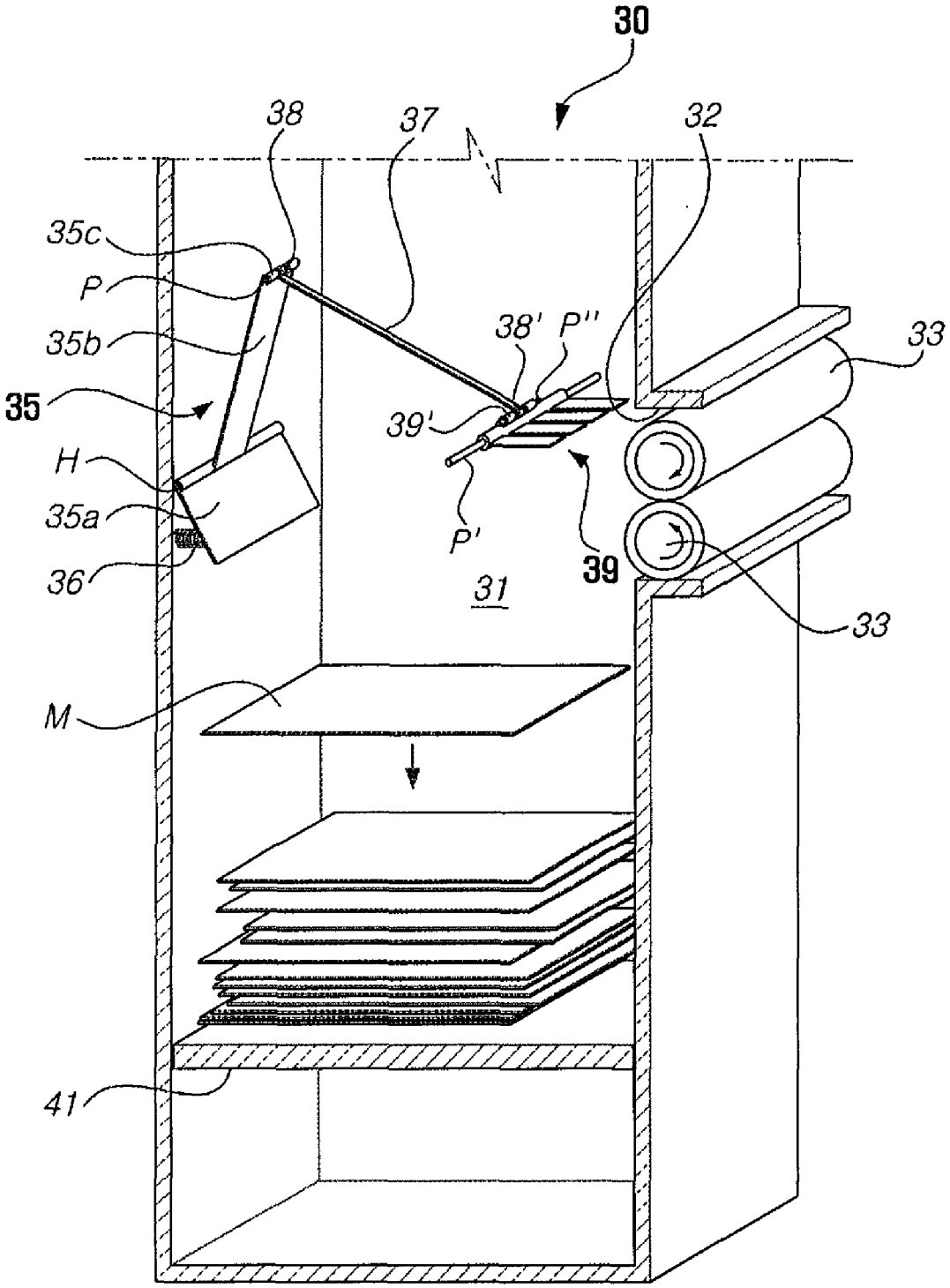

FIGS. 4 to 6 are operation state views showing a process of stacking medium by the medium stacking apparatus of an automatic medium dispenser according to the present invention.

If a customer deposits the medium M or the medium M delivered to the customer are withdraw, the medium M are conveyed toward the seating space 31. If the medium M are conveyed to the inlet opening 32 of the seating space 31, the medium reaches the inlet rollers 33.

As shown in FIG. 4, the inlet rollers 33 allow the medium M to be pulled into the seating space 31 one by one. The inlet rollers 33 rotate in opposite directions relative to one another, thereby allowing the medium M to pass through the inlet rollers one by one toward the seating space 31.

The medium M passing through the inlet rollers 33 is conveyed at a velocity of about 1,600 mm/sec by a rotational speed of the inlet rollers 33. A leading end of the medium M pulled into the seating space 31 at the above velocity collides against a front surface of the collision plate 35*a* of the damping unit 35 which is disposed to face the medium. As shown in FIG. 5, the collision plate 35*a* is pushed toward the left side in the drawing by the force generated by the collision between the medium M and the collision plate.

At this time, the elastic member 36 provided on a rear surface of the collision plate is compressed by the collision plate 35*a*. Then, in cooperation with the movement of the collision plate 35*a*, the rotating plate 35*b* of the damping unit 35 rotates clockwise in the drawing by a certain angle. In addition, the link 37 is operated by the first link ring 38 caught to the first pin ring groove 35' of the rotating plate 35*b* by the pin P.

Once the link 37 begins to operate, the second link ring 38' caught to the second pin ring groove 39" through the pin P" causes the second pin ring 39' to rotate counterclockwise in the drawing together with the pressing unit 39. The pressing unit 39 is rotated clockwise in the drawing about the pin P' as a rotational shaft. At this time, a lower end of the pressing unit 39 pushes down a trailing end of the medium M pulled into the seating space.

The trailing end of the medium M which has already collided against the collision plate 35*a* lowers, so that the medium M does not hinder the following medium from pulled into the seating space. Also, as shown in FIG. 6, the medium M is pushed down by the pressing unit 39. Simultaneously, the collision plate 35*a* rotates counterclockwise in the drawing by the elastic force of the elastic member 36, thereby reaching its original location.

In addition, the rotating plate 35*b* also rotates clockwise in the drawing, thereby reaching its original location, and the link 37 also start to operate in the reverse manner to when the medium M are stacked. Along with the operation of the link 37, the second pin ring 39' connected to the second link ring 38' by the pin P" is rotated counterclockwise in the drawing. At this time, since the second pin ring 39' is fixed to the pressing unit 39, the pressing unit 39 is rotated along with the second pin ring, thereby reaching its original location where the pressing unit is parallel with the bottom surface of the medium box 30.

Subsequently, another medium M is pulled in the seating space, and then, the aforementioned process is repeatedly performed.

If the medium M fall one by one and are stacked on the bottom surface of the seating space 31 and have a certain height, the supporting plate 41 provided in the bottom surface of the seating space 31 moves to adjust the vertical height of the seating space 31. That is, the supporting plate 41 moves downward in the seating space 31 to increase the vertical height of the seating space 31 in which the medium M can be stacked.

It will be apparent that those skilled in the art can make various modifications and changes thereto within the scope of the essential technical spirit of the invention. Therefore, the true scope of the present invention should be interpreted based on the appended claims.

The invention claimed is:

1. A medium stacking apparatus for an automatic medium dispenser, said apparatus comprising:

a medium box provided with a seating space and an inlet leading into the seating space;

feeding means for pulling a medium into the seating space;

a collision plate facing the inlet and inclined downward toward a bottom of the medium box for collision against a leading end of a medium pulled into the seating space via the inlet;

a rotating plate rotatable together with the collision plate when the leading end of the medium collides against the collision plate;

an elastic member coupled to the collision plate to elastically absorb an impact exerted on the leading end of the medium upon collision of the leading end with the collision plate; and a pressing unit coupled to the rotating plate for pressing down a trailing end of the medium after the collision of the leading end of the medium against the collision plate.

2. The medium stacking apparatus as claimed in claim 1, wherein the pressing unit is rotatable about a rotational shaft having both ends supported by the medium box, and the pressing unit comprises a pin ring provided at a position spaced apart from the rotational shaft by a predetermined distance, the pin ring being connected to the rotating plate to cooperate therewith.

3. The medium stacking apparatus as claimed in claim 2, further comprising:

a link having first and second link rings provided at both ends thereof, respectively, first and second pins passing through the first and second link rings, respectively, the link being rotatably connected to the rotating plate and the pin ring through the first and second pins, respectively.

4. A medium stacking apparatus for an automatic medium dispenser, said apparatus comprising:

a medium box provided with a seating space and an inlet leading into the seating space;

feeding means for pulling a medium into the seating space;

a damping unit for colliding against a leading end of a medium pulled into the seating space via the inlet;

a pressing unit rotatable in cooperation with the damping unit for pressing down a trailing end of the medium after the leading end of the medium collides against the damping unit; and an elastic member configured to elastically support the damping unit, the elastic member absorbing an impact exerted on the leading end of the medium upon collision of the leading end against the damping unit and elastically returning the damping unit to an initial position after the collision;

wherein the damping unit is rotatable both clockwise and counterclockwise; and wherein the damping unit comprises:

a collision plate arranged to collide with the leading end of the medium pulled into the medium box by the feeding means, and a rotating plate rotatable together with the collision plate when the leading end of the medium collides against the collision plate.

5. The medium stacking apparatus as claimed in claim 4, wherein the elastic member is provided between the damping unit and the medium box.

6. The medium stacking apparatus as claimed in claim 4, wherein the damping unit is hinged to a wall of the medium box;

the collision plate is inclined downward toward a bottom of the medium box to collide against the leading end of the medium; and the rotating plate has a width smaller than that of the collision plate.

7. The medium stacking apparatus as claimed in claim 4, wherein the pressing unit is rotatable about a rotational shaft having both ends supported by the medium box, the pressing unit comprises a pin ring provided at a position spaced apart from the rotational shaft by a predetermined distance, the pin ring being connected to the damping unit to cooperate therewith.

8. The medium stacking apparatus as claimed in claim 4, further comprising:

a link having first and second link rings provided at both ends thereof, respectively, first and second pins passing through the first and second link rings, respectively, the link being rotatably connected to the damping unit and the pressing unit through the first and second pins, respectively.

9. A medium stacking apparatus for an automatic medium dispenser, said apparatus comprising:

a medium box provided with a seating space;

feeding means for pulling a medium into the seating space;

damping means for elastically absorbing an impact exerted on a leading end of the medium pulled into the medium box by the feeding means; and pressing means for pressing down a trailing end of the medium after the medium collides against the damping means;

wherein said pressing means is arranged to rotate in cooperation with said damping means;

wherein the damping means comprises:

a damping unit arranged to collide with the leading end of the medium pulled into the medium box by the feeding means; and an elastic member coupled between the damping unit and the medium box to (i) elastically absorb the impact exerted on the leading end of the medium upon collision of the leading end with the damping unit and to (ii) elastically return the damping unit to an initial position after the collision; and wherein the damping unit is hinged to a wall of the medium box; and wherein the damping unit comprises:

a collision plate inclined downward toward a bottom of the medium box to collide against the leading end of the medium, and a rotating plate rotatable together with the collision plate when the leading end of the medium collides against the collision plate.

10. The medium stacking apparatus as claimed in claim 9, wherein the pressing means is rotatable about a rotational shaft having both ends supported by the medium box, and the pressing means comprises a pin ring provided at a position spaced apart from the rotational shaft by a predetermined distance, the pin ring being connected to the damping unit to cooperate therewith.

11. The medium stacking apparatus as claimed in claim 10, further comprising:

a link having first and second link rings provided at both ends thereof, respectively, first and second pins passing through the first and second link rings, respectively, the link being rotatably connected to the rotating plate of the damping unit and the pin ring of the pressing means through the first and second pins, respectively.

* * * * *